US008662060B2

(12) United States Patent
Walterscheid et al.

(10) Patent No.: US 8,662,060 B2
(45) Date of Patent: Mar. 4, 2014

(54) TOY BOW AND ARROW SYSTEM AND METHOD OF CONFIGURATION

(75) Inventors: Steve Walterscheid, Bend, OR (US); Brian K. Lapointe, South Dennis, MA (US); Peter Cummings, Kowloon (HK)

(73) Assignee: KMA Concepts Limited (HK)

( * ) Notice: Subject to any disclaimer, the term of this patent is extended or adjusted under 35 U.S.C. 154(b) by 450 days.

(21) Appl. No.: 12/878,985

(22) Filed: Sep. 9, 2010

(65) Prior Publication Data

US 2012/0060807 A1 Mar. 15, 2012

(51) Int. Cl.
*F41B 3/02* (2006.01)

(52) U.S. Cl.
USPC ..... 124/20.3

(58) Field of Classification Search
USPC ..... 124/20.3, 20.1
See application file for complete search history.

(56) References Cited

U.S. PATENT DOCUMENTS

| | | | | |
|---|---|---|---|---|
| 2,344,799 | A * | 3/1944 | Brown et al. | 124/22 |
| 5,247,920 | A | 9/1993 | Harbin | |
| 7,748,369 | B2 | 7/2010 | Chee | |

* cited by examiner

*Primary Examiner* — Gene Kim
*Assistant Examiner* — Amir Klayman
(74) *Attorney, Agent, or Firm* — LaMorte & Associates, P.C.

(57) ABSTRACT

A toy bow assembly used to launch toy projectiles. The toy bow assembly has a rigid bow structure. The bow structure has a first arm section, a second arm section, and a central region. Two separate and distinct elastic elements are provided to launch a projectile. The first elastic element is anchored to the first arm section of the bow structure. A second elastic element is anchored to the second arm section. Both of the elastic elements terminate with loop structures that extend into the central region between the first and second arm sections. A toy projectile is provided that has extending hooks. The hooks on the projectile engage the loop structures of the elastic elements. When the projectile is drawn back, the elastic elements stretch and provide the spring energy needed to launch the projectile into flight when it is released.

17 Claims, 5 Drawing Sheets

TOY BOW AND ARROW SYSTEM AND METHOD OF CONFIGURATION

BACKGROUND OF THE INVENTION

1. Field of the Invention

In general, the present invention relates to toy bow and arrow systems, where a toy bow is used to launch a toy arrow projectile into flight.

2. Prior Art Description

Bow and arrow sets that are designed for children's play have existed throughout recorded history. In the modern era, toy bow and arrow sets typically have a plastic molded bow, a string and safety-tipped arrows. To ensure safety, the functional design of the bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly.

Although toy bows with elastic strings are safer than flexible bows with non-elastic strings, a danger still is present. If an elastic string is stretched into a fully drawn state and the elastic string breaks near its mounting point with the bow, then the broken elastic string may whip toward the person pulling on the elastic string. The broken elastic string therefore has the potential to cause physical danger to the child pulling on the string, especially to the eyes of that child.

A need therefore exists for a toy bow and arrow design that eliminates the dangers to a child who may overdraw the bow to a point of string failure. This need is met by the present invention as described and claimed below.

SUMMARY OF THE INVENTION

The present invention is a toy bow assembly that is used to launch toy projectiles and the corresponding method of configuring the toy bow assembly. The toy bow assembly has a rigid bow structure. The bow structure has a first arm section, a second arm section, and a central region that is disposed between the first arm section and the second arm section.

Two separate and distinct elastic elements are provided to launch a projectile. The first elastic element is anchored to the first arm section of the bow structure. A second elastic element is anchored to the second arm section of the bow structure. Both of the elastic elements terminate with loop structures that extend into the central region between the first and second arm sections.

A toy projectile is provided that has extending hooks. The hooks on the projectile engage the loop structures of the elastic elements. When the projectile is drawn back, the elastic elements stretch and provide the spring energy needed to launch the projectile into flight when it is released.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy bow and arrow system can be embodied in many ways, only two embodiments of the present invention system are illustrated. These embodiments are selected in order to set forth the best modes contemplated for the invention. The illustrated embodiments, however, are merely exemplary and should not be considered limitations when interpreting the scope of the appended claims.

Figure 1:
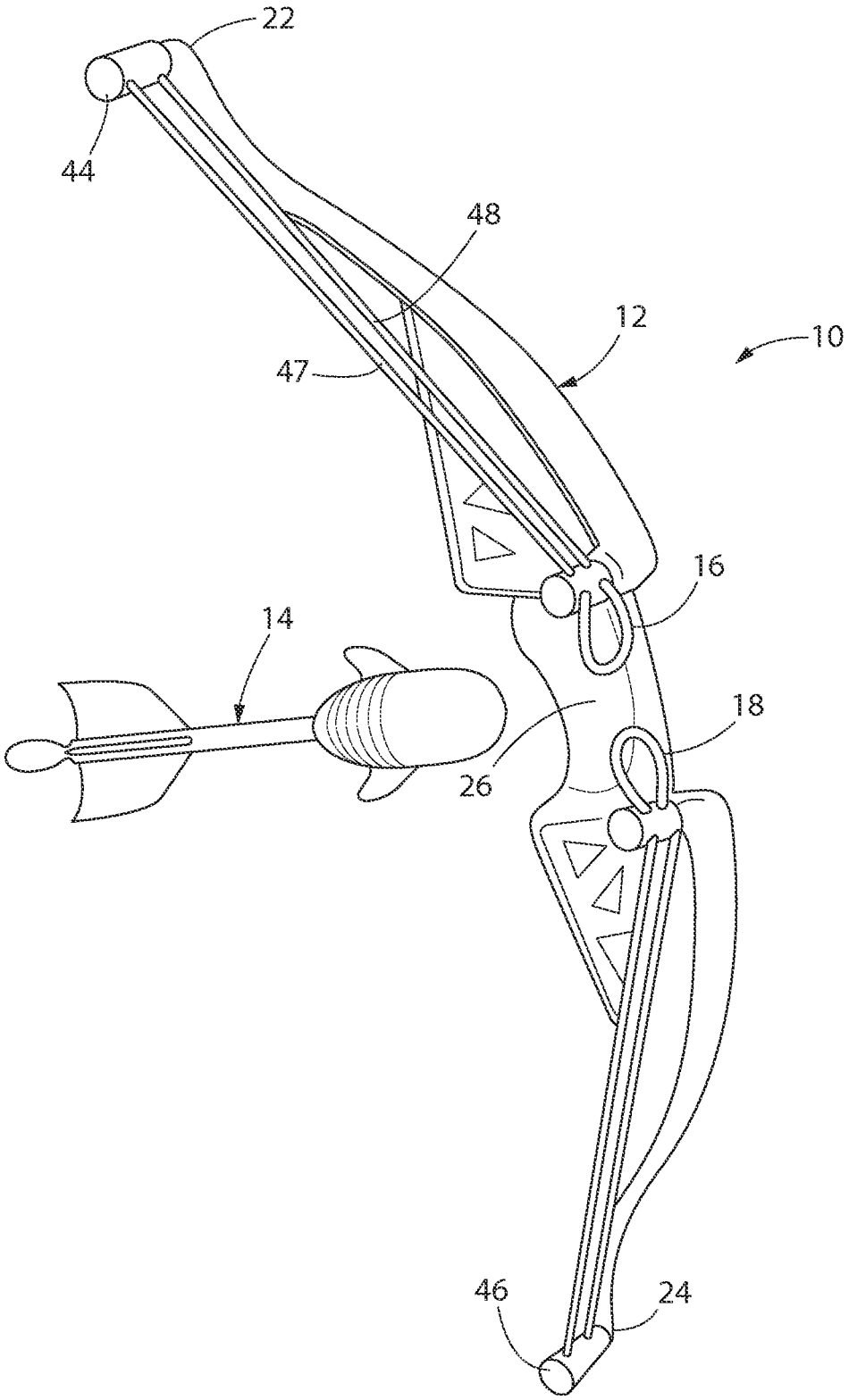
FIG. 1 is a perspective view of an exemplary embodiment of a toy bow and toy projectile in combination.

Referring to FIG. 1, a bow and arrow system 10 is shown. The bow and arrow system 10 includes a bow structure 12 and at least one arrow projectile 14. The bow structure 12 is rigid. The force used to propel the arrow projectile 14 is provided by two separate and distinct elastic loops 16, 18. The arrow projectile 14 has hook projections 60, 62 that engage both of the elastic loops 16, 18. As a person engages an arrow projectile 14 with the elastic loops 16, 18 and pulls on the arrow projectile 14, both elastic loops 16, 18 stretch. Since there are two elastic loops 16, 18, each of the elastic loops 16, 18 need only provide half the force needed to propel the arrow projectile 14 into flight. The elastic loops 16, 18 are therefore difficult to overstretch in the proper operation of the toy. Furthermore, should either of the elastic loops 16, 18 suddenly break, the orientation of the broken elastic loops prevents it from whipping toward the user. This dynamic is explained later in greater detail. Lastly, since the arrow projectile 14 engages two separate and distinct elastic loops 16, 18, the chances of both elastic loops breaking simultaneously are highly improbable. Accordingly, if one elastic loop breaks, the arrow projectile 14 will still be engaged with the second elastic loop and the person pulling the arrow projectile 14 back will not pull the arrow projectile 14 into himself upon the breakage of the one elastic loop.

Figure 2:
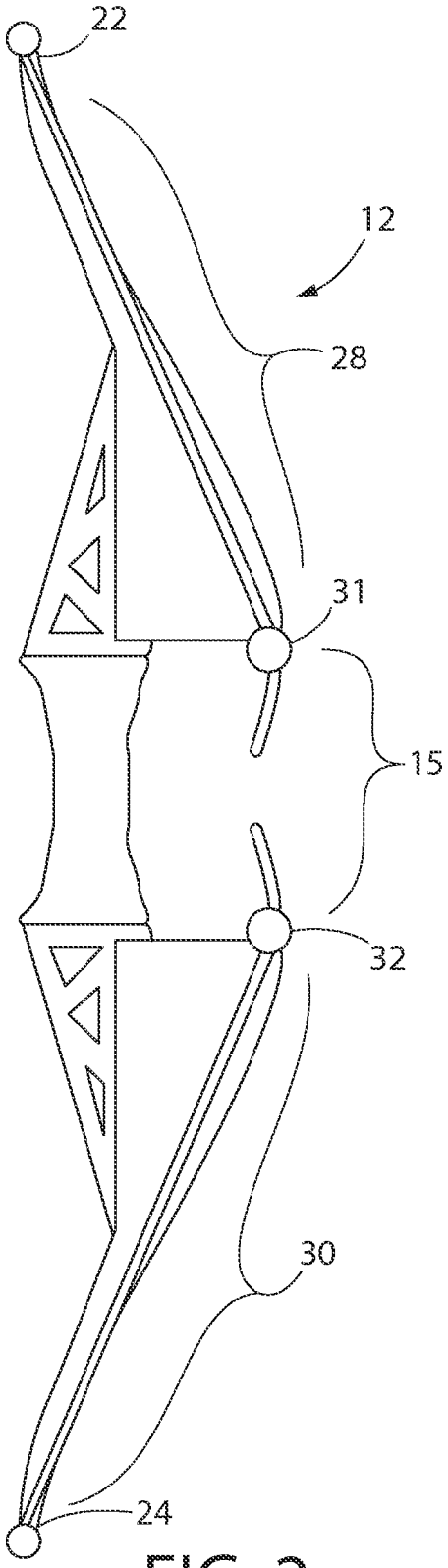
FIG. 2 is a side view of the toy bow shown in FIG. 1.

Referring to FIG. 2 in conjunction with FIG. 1, it can be seen that the bow structure 12 is a rigid molding. The bow structure 12 has a first end 22, a second end 24 and a handle 26 in its central region. A first arm section 28 extends from the handle 26 to the first end 22. Likewise, a second arm section 30 extends from the handle 26 to the second end 24. The first arm section 28 and the second arm section 30 are disposed in a common plane. The handle 26 is offset from the common plane so as not to interfere with the path of the arrow projectile 14. This creates an open central region 15 between the first and second arm sections 28, 30.

Figure 3:
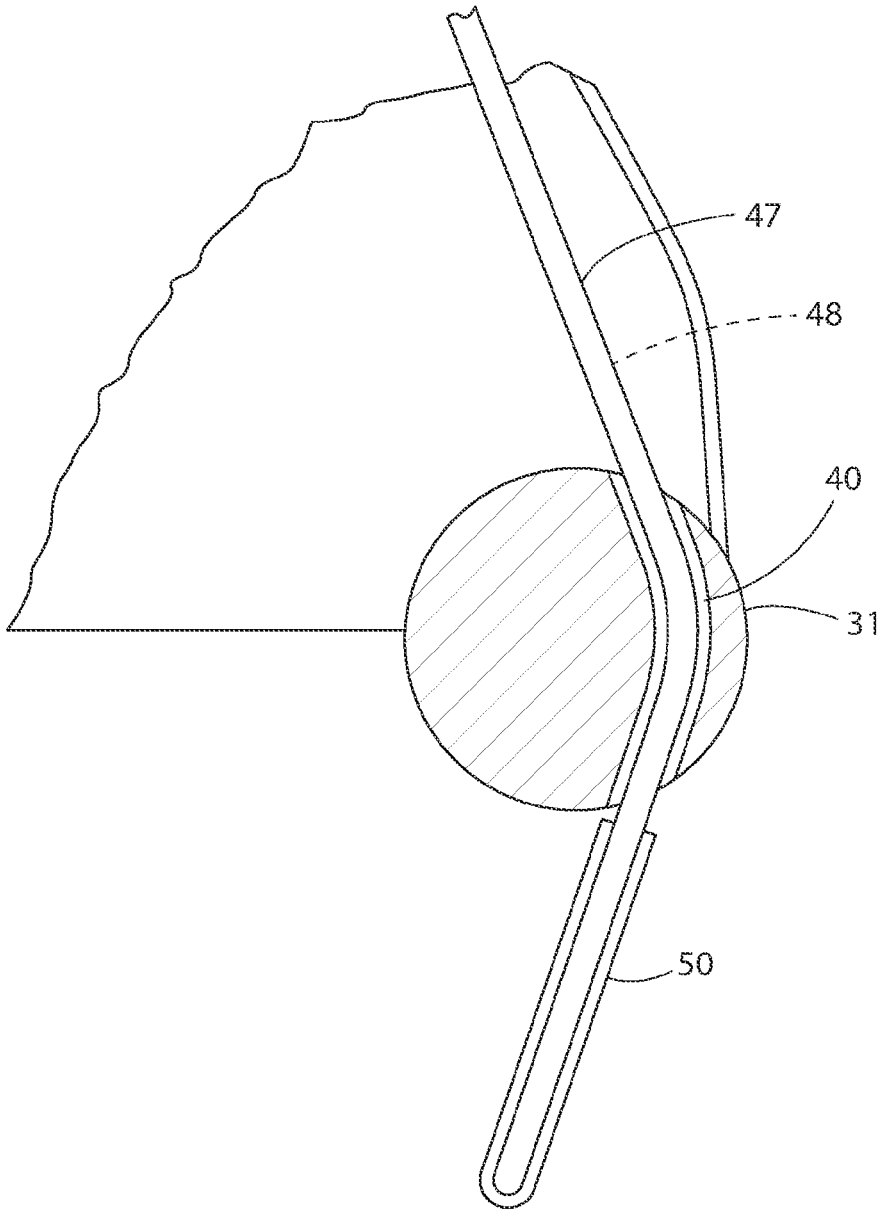
FIG. 3 is a cross-sectional view of a pivot post shown in section 3 of FIG. 2.

Two pivot post structures 31, 32 are mounted to the bow structure 12 at the bottom of the first arm section 28 and the second arm section 30. FIG. 3 shows only one of the pivot post structures 30. It will be understood that the description offered stands for both the pivot post structures 31, 32. Referring to FIG. 3 in conjunction with FIG. 2, it can be seen that each pivot post structure 31, 32 has defines two narrow openings 0. In FIG. 3, only one opening 40 is shown. It will be understood that a second opening lay below the shown opening 40 in a parallel configuration.

Each of the elastic loops 16, 18, is a loop structure that creates two runs 47, 48. The runs 47, 48 of the two elastic loops 16, 18 extend through the two openings 40 in each of the pivot post structures 40. The elastic loops 16, 18 are made of flexible lengths of elastomeric material having opposite ends. The ends of each elastic loop 16, 18 are affixed to anchored posts 44, 46 that extend from the arm sections 28, 30.

The length of elastomeric material used to form each elastic loops 16, 18 has a cross section that is smaller than the diameter of the openings 40 in the pivot post structures 31, 32. In this manner, a separate run 47, 48 of elastomeric material can pass through each of the openings 40, therein keeping the two runs 47, 48 of the loop apart.

The length of elastomeric material that forms the elastic loops 16, 18 passes through reinforcement tubes 50. The diameters of the reinforcement tubes 50 are larger than the openings 40 in the pivot post structures 31, 32. Consequently, the reinforcement tubes 50 cannot pass through the pivot post structure 31, 32. As a result, each length of elastomeric material is divided into two runs 47, 48. The first run 47 extends between an anchor post and the reinforcement tube 50 on the far side of the pivot post structure. The second run 48 extends from the reinforcement tube back to the anchor post. The looping of the elastomeric material between the two runs 47, 48 curves the reinforcement tubes 50 and creates two loading loops 54, 56.

Due to the offset of the handle 26, an open central region 15 exists between the two pivot post structures 31, 32. The loading loops 54, 56 both extend into the open central region 15 from opposite sides.

Figure 4:
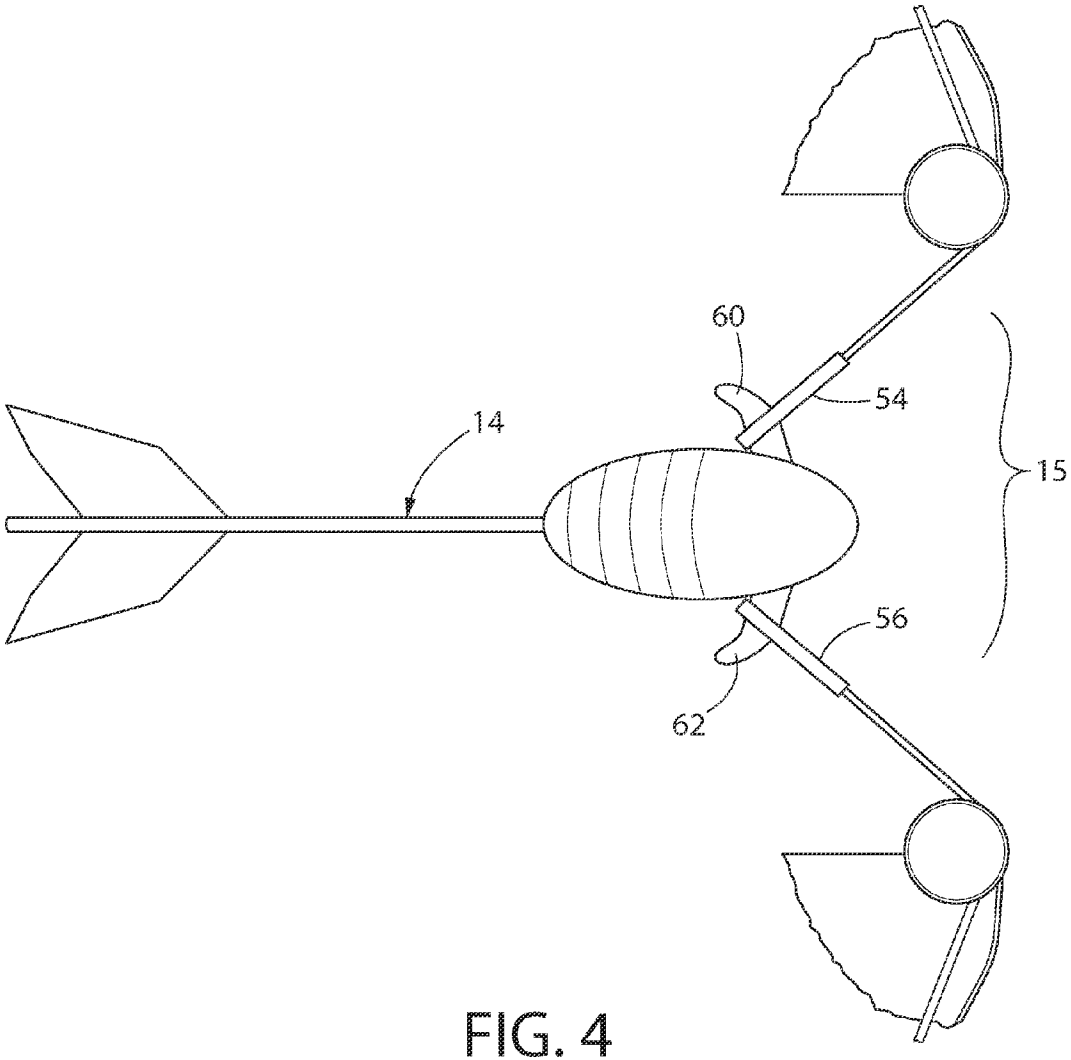
FIG. 4 shows a toy projectile engaging the loading loops within the central region of the toy bow.

Referring to FIG. 4 in conjunction with FIG. 1, it can be seen that the arrow projectile 14 has two hook elements 60, 62 extending from opposite sides. The hook elements 60, 62 are sized and shaped to engage the two loading loops 54, 56 as the hook elements 60, 62 are pulled through the open central region 15. To load the arrow projectile 14, the arrow projectile 14 is positioned within the open central region 15 so that the hook elements 60, 62 engage the loading loops 54, 56. Once engaged with the loading loops 54, 56, the arrow projectile 14 is pulled in the manner of a traditional bow and arrow. As the arrow projectile 14 is pulled away from the open central region 15, the elastic loops 16, 18 stretch. The elastic loops 16, 18 bend around the pivot post structures 31, 32, therein enabling the loading loops 54, 56 to move with the arrow projectile 14.

As the elastic loops 16, 18 stretch, they store energy. When the arrow projectile 14 is released, the elastic loops 16, 18 retract and the arrow projectile 14 is accelerated toward the open central region 15. At the open central region 15, the loading loops 54, 56 retract against the pivot post structures 31, 32. The momentum of the arrow projectile 14 causes the arrow projectile 14 to continue its forward movement past the gap. This launches the arrow projectile 14 into flight as the hook elements 60, 62 disengage the loading loops 54, 56.

When the elastic loops 16, 18 are stretched, they are most vulnerable to breakage. If one of the runs of an elastic loop 16, 18 breaks before passing through a pivot post structure 31, 32, then the speed of the contracting broken elastic loop is slowed by its passage through the pivot post structure 31, 32. This prevents a broken run from whipping toward a user. Furthermore, if a run were to brake after it passes the pivot post structure 31, 32, most of the potential energy serves to move the broken run back toward the pivot post structure 31, 32 and away from the user.

Figure 5:
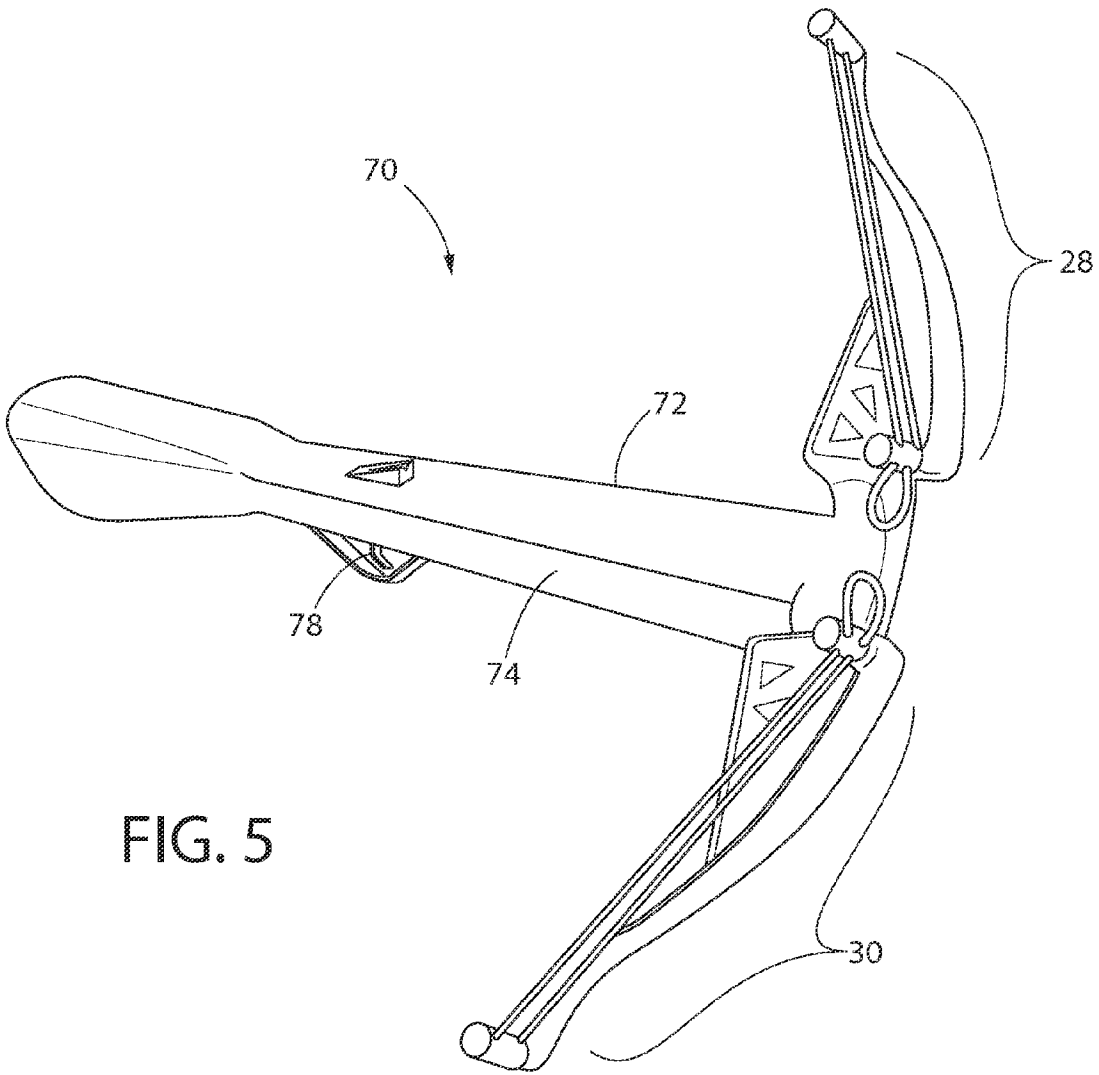
FIG. 5 is a perspective view of an alternate embodiment of the toy bow configured as a crossbow.

Referring to FIG. 5, an alternate embodiment of the present invention system 70 is shown. In this embodiment, the bow structure is configured as a crossbow 72. The crossbow 72 has arm sections 28, 30 and elastic loops 16, 18 that are the same as was previously explained. The only difference is that the structure now includes a stock 74 that can hold an arrow projectile in a loaded position. A catch 76 is provided on the stock 74 that engages the arrow projectile and prevents it from launching. The catch 76 is operated by a trigger mechanism 78 that is positioned under the stock 74. When a user activates the trigger mechanism 78, the arrow projectile is released by the catch 76 and the arrow projectile is launched into flight.

It will be understood that the embodiments of the present invention that are illustrated and described are merely exemplary and that a person skilled in the art can make many variations to those embodiments. For instance, the bow structure can have many different ornamental shapes. Likewise, the arrow projectiles can be configured as airplanes, rocket ships or any other flying projectile. All such embodiments are intended to be included within the scope of the present invention as defined by the claims.

What is claimed is:

1. A toy bow assembly used to launch toy projectiles, said toy bow assembly comprising:

a bow structure having a first arm section, a second arm section and a central region between said first arm section and said second arm section;

a first post structure and a second post structure extending from said bow structure proximate said central region on opposite sides of said central region;

a first elastic element, supported by said first arm section;

a first loop structure coupled to said first elastic element, wherein said first elastic element bends about said first post structure to position said first loop structure extends within said central region;

a second elastic element supported by said second arm section;

a second loop structure coupled to said second elastic element, wherein said second elastic element bends about said second post structure to position said second loop structure extends within said central region.

2. The assembly according to claim 1, wherein said first elastic element is coupled to a first anchor point on said first arm section, wherein said first elastic element extends from said first anchor point to said first loop structure, and wherein said first elastic element contacts said first post structure between said first anchor point and said first loop structure.

3. The assembly according to claim 2, further including a first opening at said first post structure through which said first elastic element passes, wherein said first loop structure is sized to be too large to pass through said first opening at said first post structure.

4. The assembly according to claim 2, wherein said second elastic element is coupled to a second anchor point on said second arm section, wherein said second elastic element extends from said second anchor point to said second loop structure, and wherein said second elastic element contacts said second post structure between said second anchor point and said second loop structure.

5. The assembly according to claim 4, further including a second opening at said second post structure through which said second elastic element passes, wherein said second loop structure is sized to be too large to pass through said second opening at said second post structure.

6. The assembly according to claim 1, wherein said first loop structure is formed from a looped configuration in said first elastic element.

7. The assembly according to claim 6, wherein said first elastic element passes through a reinforcement tube while forming said looped configuration.

8. The assembly according to claim 1, further including a handle, wherein said handle, said first arm section and said second arm section form a rigid bow structure.

9. A toy launching assembly used to launch toy projectiles, said assembly comprising:

a first arm section and a second arm section that are joined together by an offset handle, wherein said offset handle defines an open central region that is disposed between said first arm section and said second arm section;

a first elastic loop that extends into said open central region, wherein said first elastic loop is supported by said first arm section; and a second elastic loop that extends into said open central region, wherein said second elastic loop is supported by said second arm section, wherein said first elastic loop and said second elastic loop are separate, distinct and separated by a gap within said open central region.

10. The assembly according to claim 9, further including a first pivot position and a second pivot position located proximate said open central region on opposite sides of said central region.

11. The assembly according to claim 10, wherein said first elastic loop is coupled to a first anchor point on said first arm section.

12. The assembly according to claim 11, further including a first pivot position around which said first elastic loop bends.

13. The assembly according to claim 11, wherein said second elastic loop is coupled to a second anchor point on said second arm section.

14. The assembly according to claim 13, further including a second pivot position around which said second elastic loop bends.

15. The assembly according to claim 9 further including reinforcement elements for reinforcing said first elastic loop and said second elastic loop in said open central region.

16. A toy launching assembly used to launch toy projectiles, said assembly comprising:

a rigid structure having a handle for holding said rigid structure, wherein said handle is offset and defines an open area;

a continuous first elastic element having a first run, a second run and a bend between said first run and said second run that creates a first loop in said first elastic element, wherein said first run and said second run are both anchored to said rigid structure, wherein said first elastic loop extends in a first direction from said rigid structure into said open area; and a second continuous elastic element having two runs and a bend between said two runs that creates a second loop in said second elastic element, wherein said first run and said second run are both anchored to said rigid structure, wherein said second elastic loop extends in a second direction from said rigid structure into said open area, wherein said second direction is generally opposite said first direction.

17. The assembly according to claim 16, further including a first pivot position and a second pivot position located proximate said open area on opposite sides of said central region, wherein said first run and said second run of said first elastic element bend around said first pivot position and wherein said two runs of said second elastic element bend around said second pivot position.

* * * * *